US011371204B2

(12) United States Patent
Kang

(10) Patent No.: US 11,371,204 B2
(45) Date of Patent: Jun. 28, 2022

(54) RING-SHAPED COFFERDAM AND TEMPORARY PIT EXCAVATION STRUCTURE USING TAPERED SQUARE PIPE, AND CONSTRUCTION METHOD THEREOF

(71) Applicant: Byung Kwan Kang, Seongnam-si (KR)

(72) Inventor: Byung Kwan Kang, Seongnam-si (KR)

( * ) Notice: Subject to any disclaimer, the term of this patent is extended or adjusted under 35 U.S.C. 154(b) by 0 days.

(21) Appl. No.: 17/277,283

(22) PCT Filed: Apr. 3, 2019

(86) PCT No.: PCT/KR2019/003913
§ 371 (c)(1),
(2) Date: Mar. 17, 2021

(87) PCT Pub. No.: WO2020/085590
PCT Pub. Date: Apr. 30, 2020

(65) Prior Publication Data

US 2021/0348358 A1 Nov. 11, 2021

(30) Foreign Application Priority Data

Oct. 24, 2018 (KR) ..... 10-2018-0127445

(51) Int. Cl.
*E02D 19/04* (2006.01)
*E02D 17/04* (2006.01)

(52) U.S. Cl.
CPC ..... *E02D 19/04* (2013.01); *E02D 17/04* (2013.01); *E02D 2200/1657* (2013.01); *E02D 2600/10* (2013.01); *E02D 2600/20* (2013.01)

(58) Field of Classification Search
CPC ..... E02D 17/04; E02D 19/02; E02D 19/04; E02D 23/00; E02D 25/00
(Continued)

(56) References Cited

U.S. PATENT DOCUMENTS 731,742 A * 6/1903 Beaumont ..... E21B 43/086 166/227
923,975 A * 6/1909 Johnston ..... E04B 2/8629 52/439
(Continued)

FOREIGN PATENT DOCUMENTS

CN 107217676 A 9/2017
CN 107268636 A * 10/2017
(Continued)

OTHER PUBLICATIONS

International Search Report for PCT/KR2019/003913 dated Jul. 19, 2019 from Korean Intellectual Property Office.
(Continued)

*Primary Examiner* — Frederick L Lagman
(74) *Attorney, Agent, or Firm* — Revolution IP, PLLC

(57) ABSTRACT

A ring-shaped cofferdam and temporary pit excavation structure using tapered square pipes includes a plurality of tapered square pipes a trapezoidal cross-section, in which the plurality of tapered square pipes each have a coupling protrusion or a coupling groove formed in a longitudinal direction on a first side, the plurality of tapered square pipes each have a coupling protrusion or a coupling groove formed in the longitudinal direction on a second side, the plurality of tapered square pipes are assembled by coupling the coupling protrusions and the coupling grooves, a long side of two parallel sides of the trapezoid is disposed outside, and a short side is disposed inside.

15 Claims, 13 Drawing Sheets

(58) Field of Classification Search
USPC ..... 405/14
See application file for complete search history.

(56) References Cited

U.S. PATENT DOCUMENTS

| | | | | | |
|---|---|---|---|---|---|
| 3,555,751 | A | | 1/1971 | Thorgusen | |
| 4,118,941 | A | * | 10/1978 | Bruce | E02D 25/00 405/204 |
| 4,202,647 | A | * | 5/1980 | Lamy | E02B 17/02 405/203 |
| 4,963,058 | A | * | 10/1990 | Broughton | E02B 17/0017 405/207 |
| 5,088,858 | A | * | 2/1992 | Massoudi | E02D 23/02 405/203 |
| 5,987,845 | A | * | 11/1999 | Laronde | B27M 3/0053 52/591.1 |
| 10,065,712 | B2 | * | 9/2018 | Hallai | B63B 5/18 |
| 2014/0166649 | A1 | | 6/2014 | Hoopes et al. | |
| 2016/0138239 | A1 | * | 5/2016 | Lvarez Grac A-Luben | E02D 25/00 405/13 |

FOREIGN PATENT DOCUMENTS

| | | | | |
|---|---|---|---|---|
| CN | 107326904 | A | | 11/2017 |
| CN | 208501718 | U | * | 2/2019 |
| JP | 53-101809 | A | | 9/1978 |
| JP | 54-162804 | A | | 12/1979 |
| JP | 2004324377 | A | * | 11/2004 |
| KR | 10-0627709 | B1 | | 9/2006 |
| KR | 10-2008-0065333 | A | | 7/2008 |
| KR | 10-1022841 | B1 | | 3/2011 |
| KR | 10-1118734 | B1 | | 3/2012 |
| KR | 10-1255961 | B1 | | 4/2013 |
| KR | 10-1859440 | B1 | | 5/2018 |
| KR | 10-2018-0084411 | A | | 7/2018 |
| KR | 2011321 | B1 | * | 10/2019 |
| KR | 20200107521 | A | * | 9/2020 |

OTHER PUBLICATIONS

European Search Report of European Patent Application No. 19876094 dated Nov. 22, 2021.

* cited by examiner

RING-SHAPED COFFERDAM AND TEMPORARY PIT EXCAVATION STRUCTURE USING TAPERED SQUARE PIPE, AND CONSTRUCTION METHOD THEREOF

TECHNICAL FIELD

The present invention relates to a ring-shaped cofferdam and temporary pit excavation structure using pipes and, more particularly, to a ring-shaped cofferdam and temporary pit excavation structure using pipes having a trapezoidal cross-section.

BACKGROUND ART

A cofferdam, which is a structure temporarily installed to block water or earth and sand at construction sites, is generally constructed by boring or driving usually H-beams, cylindrical pies, or sheet piles.

FIG. 1 is a view showing the configuration of a temporary structure for blocking earth and sand in the related art. Referring to FIG. 2, the structure includes sheet piles 1 disposed outside, wales 2 horizontally attached to the sheet piles 2, struts 3 perpendicularly connected to the wales 2 in the same plane, and center piles 4 vertically installed in the ground.

However, this temporary structure of the related art is insufficient in strength because the sheet piles 1 are used, so the members such as the wales 2, struts 3, and center piles 4 are additionally required. Further, the structure is largely influenced by side pressure, depending on the depth, so the deeper the structure, the more the wales 2, struts 3, and the center piles 4 are needed.

Further, due to the additionally installed wales 2, struts 3, and center piles 4, the temporary structure of the related art has the problem that it is difficult to secure a sufficient work space, construction is difficult, and a large cost is required because it is difficult to reduce the construction period.

Further, there is Korean Patent No. 10-1022841 (titled, WAVE PATTERN STEEL BEAM OR CUTTING PATTERN STEEL BEAM HAVING A TEMPORARY COFFER DAM) in relation to a cofferdam in the related art, but, which has a problem that the strength of a single sheet pile wall installed in a row is low due to the characteristics of steel, to the wall is easily deformed by side pressure and there is a need for a specific method for supporting the wall using supports, etc.

A two-row sheet pile wall is used at areas with large side pressure to solve this problem, such a two-row water stop cofferdam wall is embedded in the ground by driving sheet piles in two rows, and the space between the two rows of sheet piles is usually filled with good-quality soil (yellow soil) or sand as a geomembrane (filler material). Further, tie cables are bound left and right and up and down with regular intervals to prevent the walls from opening or bulging due to the weight of the soil when the good-quality soil is poured between the walls, which is a method that is generally used to prevent sheet pile walls from being deformed and opened is generally used.

However, since cofferdam walls are usually installed in the water or ground with regular intervals, there is a need for underwater work by divers when they are installed in the water, and it is difficult to realistically install any supporting structure for the sections of walls embedded in the ground. Accordingly, such a method using tie cables in the related art has many problems.

In order to solve this problem, there is Korean Patent No. 10-1859440 (titled, CONSTRUCTION METHOD OF CONTEMPORARY FACILITY OF COMPLEX STEEL USING CONNECTING MEANS BETWEEN COFFERDAM). However, this technology still has a problem of inconvenience in construction that it is required to fill spaces with a filler because sheet piles are used.

It may be possible to construct a cofferdam using a plurality of cylindrical piles in order to solve this inconvenience, but such cylindrical piles are manufactured through a process of winding plates, so there is a limit in thickness. Further, the strength is not sufficient for areas with large side pressure.

DISCLOSURE

Technical Problem

The present invention has been made in an effort to solve the problems of the related art and an object of the present invention is to provide a ring-shaped cofferdam and temporary pit excavation structure that is little influenced by excavation depth using pipes having a trapezoidal cross-section and using an arch structure such that a component of force (compression force) acts between the pipes.

Further, an object of the present invention is to provide a ring-shaped cofferdam and temporary pit excavation structure that makes it easy to secure a work space because there is no need for a wale, a strut, and a center pile.

Further, an object of the present invention is to provide a ring-shaped cofferdam and temporary pit excavation structure that can be easily constructed and can be clearly structurally analyzed because the structure is simple.

Further, an object of the present invention is to provide a ring-shaped cofferdam and temporary pit excavation structure that makes it possible to reduce a construction period and can be easily disassembled because welding or filling with concrete is not used.

Further, an object of the present invention is to provide a ring-shaped cofferdam and temporary pit excavation structure that is economically excellent.

Technical Solution

In order to achieve the objects of the present invention, a ring-shaped cofferdam and temporary pit excavation structure using pipes includes a plurality of pipes a trapezoidal cross-section, in which the plurality of pipes each have a coupling protrusion or a coupling groove formed in a longitudinal direction on a first side, the plurality of pipes each have a coupling protrusion or a coupling groove formed in the longitudinal direction on a second side, the plurality of pipes are assembled by coupling the coupling protrusions and the coupling grooves, a long side of two parallel sides of the trapezoid is disposed outside, and a short side is disposed inside.

In the ring-shaped cofferdam and temporary pit excavation structure using pipes, the coupling protrusion of the first pipe may have a rectangular cross-section and the coupling groove of the second pipe may be formed to correspond to the coupling protrusion.

In the ring-shaped cofferdam and temporary pit excavation structure using pipes, the coupling protrusion of the first pipe may have a T-shaped cross-section and the coupling groove of the second pipe may be formed to correspond to the coupling protrusion.

In the ring-shaped cofferdam and temporary pit excavation structure using pipes, the coupling protrusion of the first pipe may have a trapezoidal cross-section and the coupling groove of the second pipe may be formed to correspond to the coupling protrusion.

In the ring-shaped cofferdam and temporary pit excavation structure using pipes according to an embodiment of the present invention, the first pipe and the second pipe may be combined by welding four flat plates.

The ring-shaped cofferdam and temporary pit excavation structure using pipes according to an embodiment of the present invention may further include a guide member that is fitted in an upper end of one of the plurality of pipes, in which the guide member may have: a fitting portion that is fitted in an upper end of one of the plurality of pipes; and a guide portion that horizontally extends from the fitting portion.

Further, in the ring-shaped cofferdam and temporary pit excavation structure using pipes according to an embodiment of the present invention, the tapered cross-sections of some of the plurality of pipes may be inclined at different angles, whereby it may have entirely an elliptical shape.

The ring-shaped cofferdam and temporary pit excavation structure using pipes according to an embodiment of the present invention may further include an anchor an anchor member that is fitted in a lower end of one of the plurality of pipes, in which the anchor member may have: a fitting portion formed at an upper end of the anchor member to be fitted in a lower end of one of the plurality of pipes; and an anchor portion extending a predetermined length from the fitting portion and decreasing in cross-sectional area toward a lower end, and an upper end of the anchor portion may be larger in cross-sectional area than the fitting portion.

A method of constructing a ring-shaped cofferdam and temporary pit excavation structure using pipes according to an embodiment of the present invention includes: driving a first pipe having a coupling groove formed in a longitudinal direction on a side; putting a second pipe having a coupling protrusion formed in a longitudinal direction on a side close to an upper end of the first pipe; fitting the coupling protrusion of the second pipe into the coupling groove of the first pipe; and driving the second pipe with the coupling protrusion of the second pipe fitted in the coupling groove of the first pipe.

The method of constructing a ring-shaped cofferdam and temporary pit excavation structure using pipes according to an embodiment of the present invention may further include welding respectively the first pipe and the second pipe before the driving of the first pipe, in which, in the welding, the first pipe and the second pipe may be respectively welded using four flat plates.

The method of constructing a ring-shaped cofferdam and temporary pit excavation structure using pipes according to an embodiment of the present invention may further include: measuring side pressure of an area where the first pipe and the second pipe are installed; determining thickness of the plates in accordance with the result of measuring the side pressure.

In the method of constructing a ring-shaped cofferdam and temporary pit excavation structure using pipes according to an embodiment of the present invention, the determining of thickness of the plates in accordance with the result of measuring the side pressure may determine the thickness of the plates as 10% or less of entire width of the first pipe or the second pipe when the measured side pressure is less than a predetermined value, as the result of measurement.

In the method of constructing a ring-shaped cofferdam and temporary pit excavation structure using pipes according to an embodiment of the present invention, the determining of thickness of the plates in accordance with the result of measuring the side pressure may determine the thickness of the plates as 11% or more of entire width of the first pipe or the second pipe when the measured side pressure is a predetermined value or more, as the result of measurement.

The method of constructing a ring-shaped cofferdam and temporary pit excavation structure using pipes according to an embodiment of the present invention may further include coupling a guide member to the upper end of the first pipe after the driving of the first pipe, in which the guide member may have: a fitting portion that is fitted in an upper end of one of the plurality of pipes; and a guide portion that horizontally extends from the fitting portion.

The method of constructing a ring-shaped cofferdam and temporary pit excavation structure using pipes according to an embodiment of the present invention may include, after the coupling of the guide member: putting the second pipe to the upper end of the first pipe; fitting the coupling protrusion of the second pipe into the coupling groove of the first pipe through the guide member; and driving the second pipe with the coupling protrusion of the second pipe fitted in the coupling groove of the first pipe.

Advantageous Effects

The ring-shaped cofferdam and temporary pit excavation structure using pipes according to an embodiment of the present invention uses pipes having a trapezoidal cross-section and uses an arch structure such that a component of force (compression force) acts between the pipes, so there is little influence by excavation depth, and accordingly, the structure can be applied to a site with large depth.

Further, the ring-shaped cofferdam and temporary pit excavation structure using pipes according to an embodiment of the present invention does not need a wale, a strut, and a center pile, so it is advantageous to secure a work space.

Further, the ring-shaped cofferdam and temporary pit excavation structure using pipes according to an embodiment of the present invention has a simple structure, so the structure that can be easily constructed and can be clearly structurally analyzed.

Further, the ring-shaped cofferdam and temporary pit excavation structure using pipes according to an embodiment of the present invention has a simple structure, so the structure that can be easily constructed and can be clearly structurally analyzed.

Further, the ring-shaped cofferdam and temporary pit excavation structure using pipes according to an embodiment of the present invention makes it possible to reduce a construction period and can be easily disassembled because welding or filling with concrete is not used.

As described above, the present invention enables construction with very less components in comparison to the related art (there is no need for a wale, a strut, a center pile, etc.), so it is economically excellent.

BEST MODE

Figure 1:
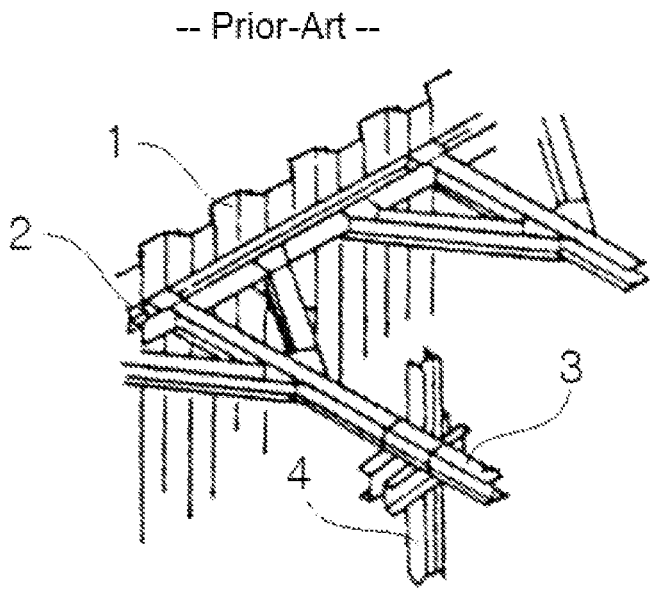
FIG. 1 is a view showing the configuration of a temporary structure for blocking earth and sand in the related art.

When it is determined that the subject of the present invention may be unnecessarily made unclear, the detailed description will be omitted.

Embodiments described herein may be changed in various ways and various shapes, so specific embodiments are shown in the drawings and will be described in detail in this specification. However, it should be understood that the exemplary embodiments according to the concept of the present disclosure are not limited to the embodiments which will be described hereinbelow with reference to the accompanying drawings, but all of modifications, equivalents, and substitutions are included in the scope and spirit of the disclosure.

It is to be understood that when one element is referred to as being "connected to" or "coupled to" another element, it may be connected directly to or coupled directly to another element or be connected to or coupled to another element, having the other element intervening therebetween. On the other hand, it is to be understood that when one element is referred to as being "connected directly to" or "coupled directly to" another element, it may be connected to or coupled to another element without the other element intervening therebetween. Further, the terms used herein to describe a relationship between elements, that is, "between", "directly between", "adjacent" or "directly adjacent" should be interpreted in the same manner as those described above.

Terms used in the present invention are used only in order to describe specific exemplary embodiments rather than limiting the present invention. Singular forms are intended to include plural forms unless the context clearly indicates otherwise. It will be further understood that the terms "comprises" or "have" used in this specification, specify the presence of stated features, steps, operations, components, parts, or a combination thereof, but do not preclude the presence or addition of one or more other features, numerals, steps, operations, components, parts, or a combination thereof.

Figure 2:
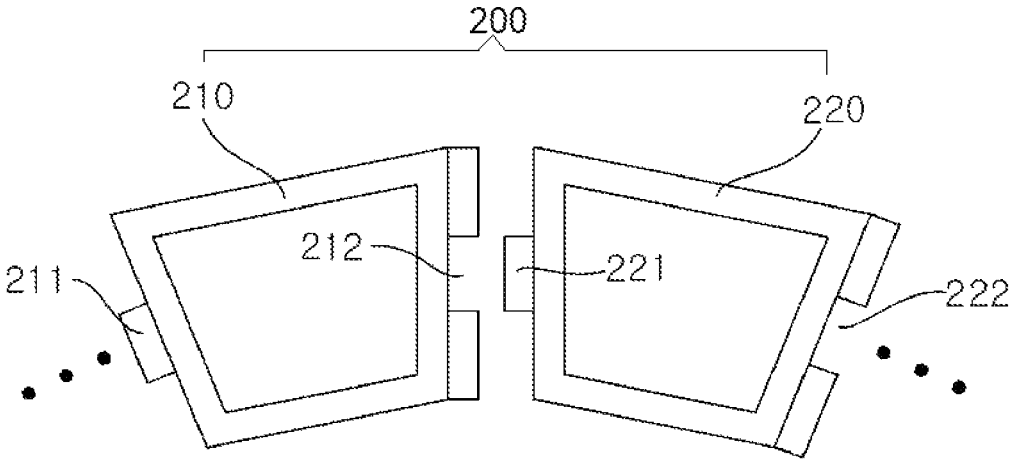
FIG. 2 is a view showing a coupling structure of a ring-shaped cofferdam and temporary pit excavation structure using pipes according to an embodiment of the present invention.
Figure 3:
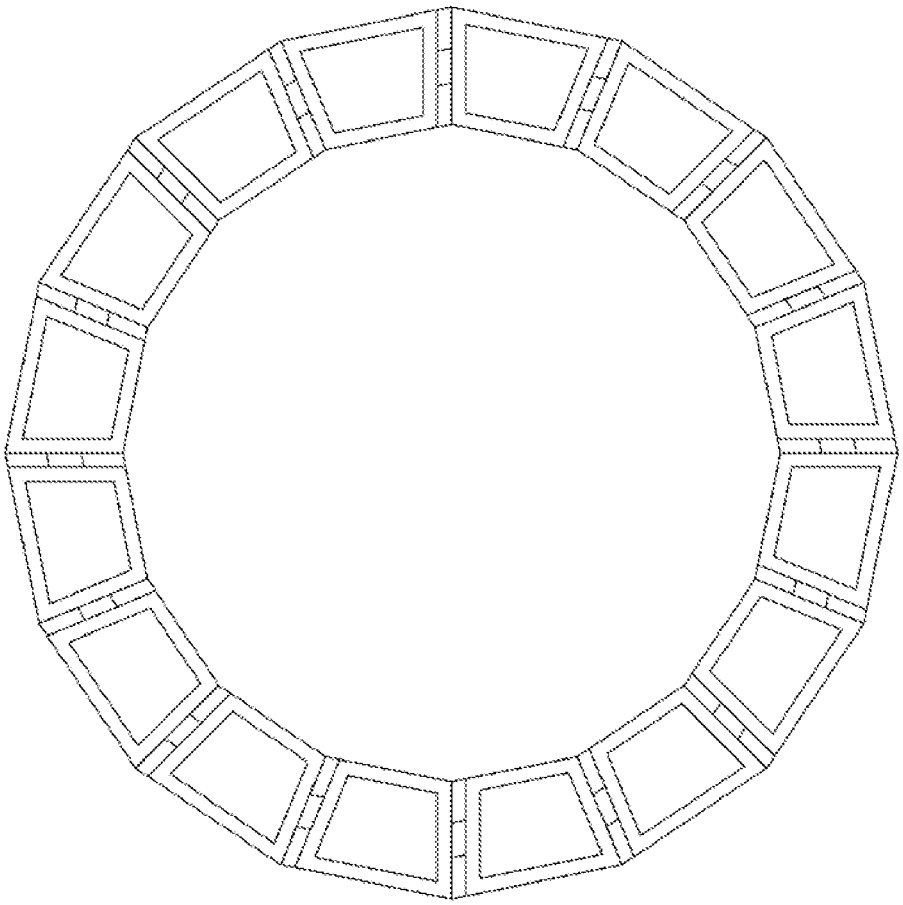
FIG. 3 is a plan view of the ring-shaped cofferdam and temporary pit excavation structure using pipes according to an embodiment of the present invention.

FIG. 2 is a view showing a coupling structure of a ring-shaped cofferdam and temporary pit excavation structure using pipes according to an embodiment of the present invention and FIG. 3 is a plan view of the ring-shaped cofferdam and temporary pit excavation structure using pipes according to an embodiment of the present invention.

Referring to FIG. 2, a ring-shaped cofferdam and temporary pit excavation structure using pipes according to an embodiment of the present invention includes a plurality of pipes 200 having a trapezoidal cross-section. The pipes each may have a coupling protrusion or a coupling groove formed in the longitudinal direction on a first side and a coupling protrusion or a coupling groove formed in the longitudinal direction on a second side.

In detail, as shown in FIG. 2 (the right pipe is referred to as a first pipe and the left pipe is referred to as a second pipe for helping understanding), a coupling protrusion 211 may be formed on a first side (left side) of the first pipe 210 and a coupling groove 212 may be formed on a second side (right side) of the first pipe 210.

Further, a coupling protrusion 221 may be formed on a first side (left side) of the second pipe 220 and a coupling groove 222 may be formed a second side (right side) of the second pipe 220.

Further, in the ring-shaped cofferdam and temporary pit excavation structure using pipes according to an embodiment of the present invention, the pipes are assembled by coupling the coupling protrusions and the coupling grooves with the long side of two parallel sides of the trapezoid disposed outside and the short side disposed inside, whereby a ring-shaped cofferdam structure can be achieved.

FIG. 3 is a plan view of the ring-shaped cofferdam and temporary pit excavation structure using pipes that has the coupling structure described above in accordance with an embodiment of the present invention.

The ring-shaped cofferdam and temporary pit excavation structure using pipes according to an embodiment of the present invention uses pipes having a trapezoidal cross-section and uses an arch structure such that a component of force (compression force) acts between the pipes, so there is an effect that a supporting force is considerably improved.

Further, the ring-shaped cofferdam and temporary pit excavation structure using pipes according to an embodiment of the present invention has various advantages in comparison to the related art, and one of the advantages is that the structure can be constructed at a place with large side pressure.

In the related art, a two-row sheet pile wall is used at areas with large side pressure to solve this problem, such a two-row water stop cofferdam wall is embedded in the ground by driving sheet piles in two rows, and the space between the two rows of sheet piles is usually filled with good-quality soil (yellow soil) or sand as a geomembrane (filler material). Further, tie cables are bound left and right and up and down with regular intervals to prevent the walls from opening or bulging due to the weight of the soil when the good-quality soil is poured between the walls, which is a method that is generally used to prevent sheet pile walls from being deformed and opened is generally used.

However, the ring-shaped cofferdam and temporary pit excavation structure using pipes according to an embodiment of the present invention is constructed by coupling a plurality of pipes and walls are formed by two-row plates. Accordingly, it is possible to achieve the same effect as the case when sheet piles are arranged in two rows.

That is, the ring-shaped cofferdam and temporary pit excavation structure using pipes according to an embodiment of the present invention has the advantage that it is possible to prevent a wall from deforming and opening even without using tie cables and wales.

Further, in the ring-shaped cofferdam and temporary pit excavation structure using pipes according to an embodiment of the present invention, the coupling protrusions formed on the pipes are fitted in corresponding coupling grooves, respectively, and the coupling grooves function as guides when they are coupled. Accordingly, convenience of construction is improved and the strength of the entire structure can be improved by maintaining a firm coupling structure after coupling them, so excellent supporting force can be secured.

Further, a plurality of pipes according to an embodiment of the present invention may be coupled by welding four flat plates.

There is a method of constructing a cofferdam using a plurality of cylindrical piles as one of technologies of constructing a cofferdam in the related art, but such cylindrical piles are manufactured through a process of winding plates, so there is a limit in thickness.

In detail, the since the cylindrical piles are manufactured by winding plates, the diameter of the entire cylindrical piles is unavoidably influenced by the thickness of the plates. The diameter of the cylindrical piles and the thickness of the plates are in a proportional relationship. Accordingly, the thickness of the plates is influenced by the diameter of the entire cylindrical piles.

If a cofferdam structure is constructed at a place with large side pressure using cylindrical piles, it is required to secure a large supporting force due to the large side pressure and plates have to be thick to secure a large supporting force. However, when the thickness of plates is increased, the diameter of the entire cylindrical pies is increased, so construction is difficult. Further, the wall of the cofferdam structure is excessively thick, so the space that is secured inside may be reduced.

However, the ring-shaped cofferdam and temporary pit excavation structure using pipes according to an embodiment of the present invention uses a plurality of pipes and the pipes are coupled by welding four flat plates. Accordingly, it is possible to maintain the width of the entire pipes (corresponding to the diameter of cylindrical piles) and increase the thickness of plates.

Therefore, the ring-shaped cofferdam and temporary pit excavation structure using pipes according to an embodiment of the present invention can be very simply constructed at a place with large side pressure, as compared with using cylindrical piles in the related art, by removing the problems described above, thereby being able to secure a sufficient space inside the cofferdam structure.

MODE FOR INVENTION

Figure 4:
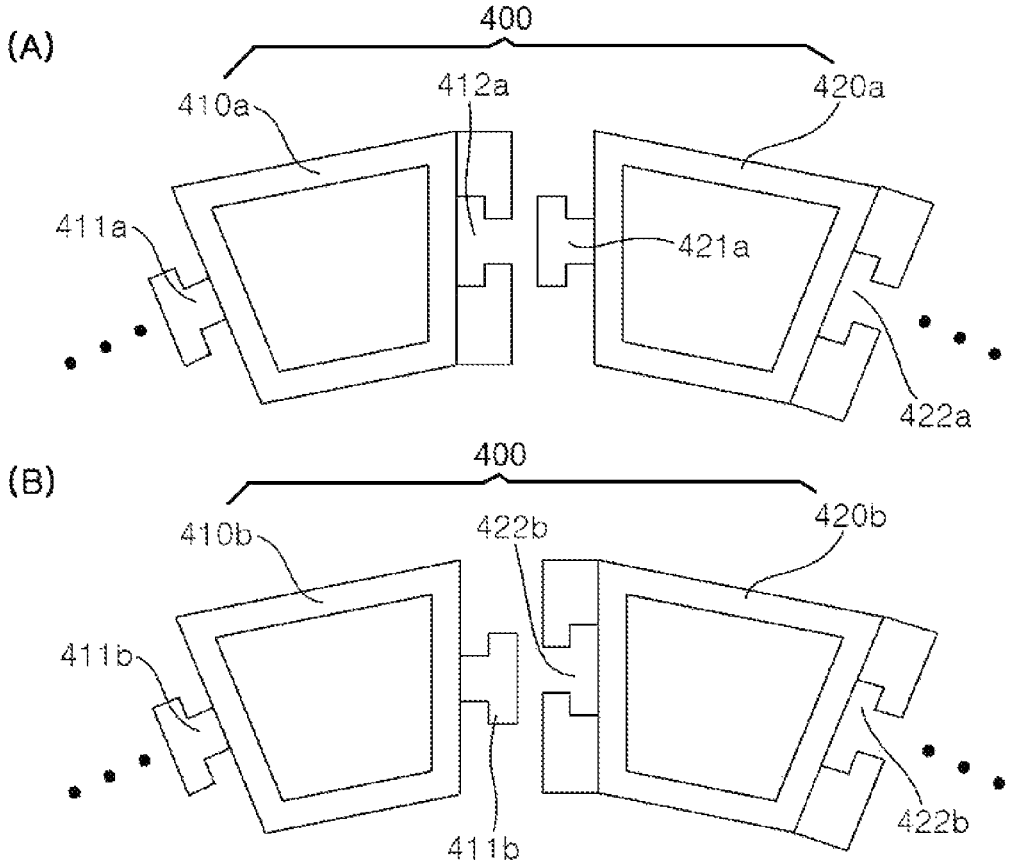
FIGS. 4 to 6 are views showing another coupling structure of a ring-shaped cofferdam and temporary pit excavation structure using pipes according to an embodiment of the present invention.
Figure 5:
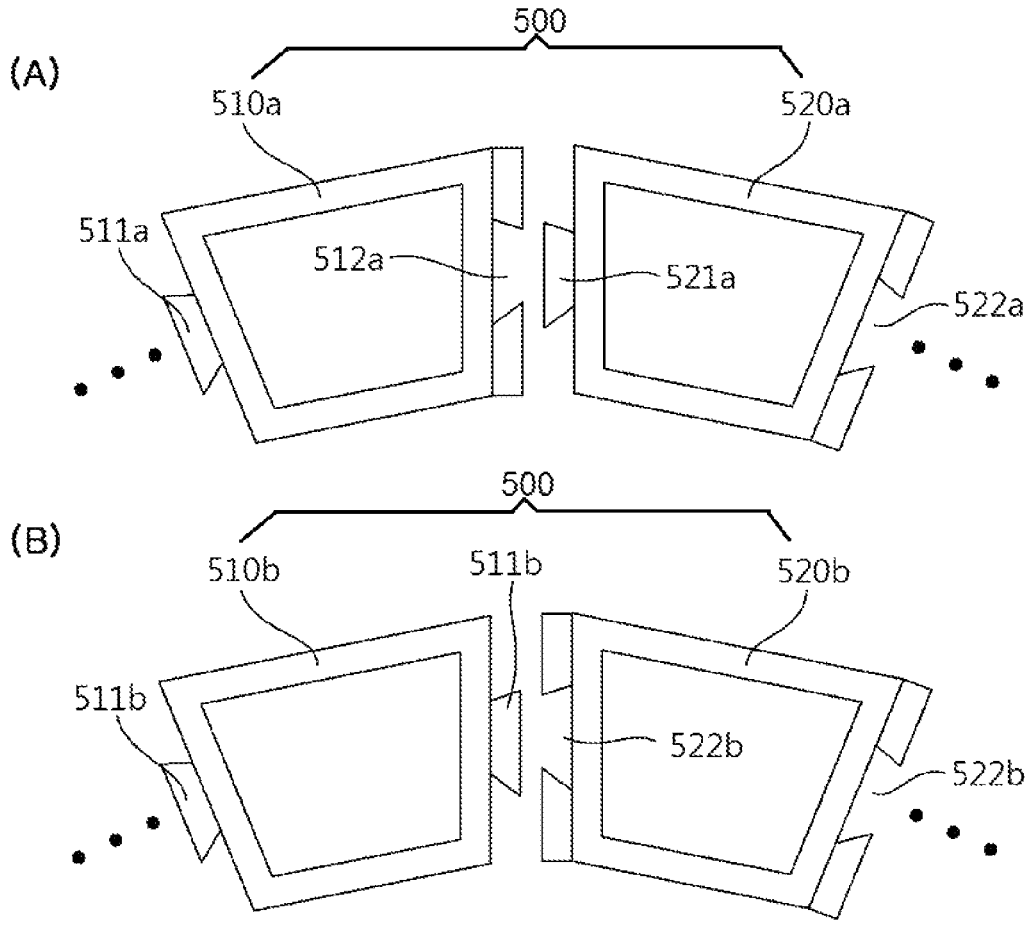
Figure 6:
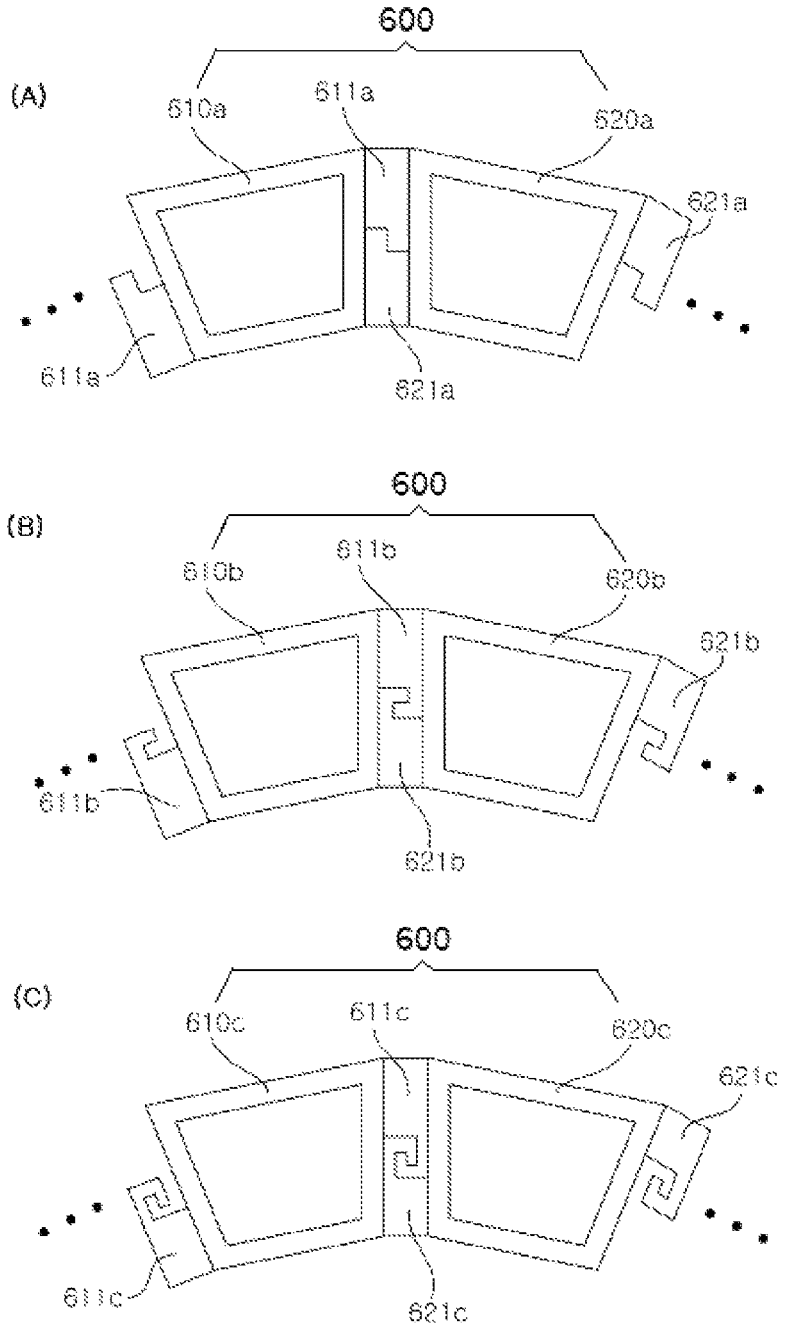

FIGS. 4 to 6 are views showing another coupling structure of a ring-shaped cofferdam and temporary pit excavation structure using pipes according to an embodiment of the present invention.

Referring to FIG. 4A, in a ring-shaped cofferdam and temporary pit excavation structure using pipes 400 according to an embodiment of the present invention, when a first pipe 410*a* that is one of a plurality of pipes 410*a* and 420*a* has a coupling protrusion 411*a* formed in the longitudinal direction and a second pipe 420*a* that is one of the plurality of pipes 410*a* and 420*a* has a coupling groove 422*a* formed in the longitudinal direction to fit the coupling protrusion 411*a* therein, the coupling protrusion 411*a* of the first pipe 410*a* may have a T-shaped cross-section and the coupling groove 422*a* of the second pipe 420*a* may be formed to correspond go the coupling protrusion 411*a*.

In the case of FIG. 4, the supporting force between the first pipe and the second pipe can be further improved than the case of FIG. 2.

Further, referring to FIG. 4B, coupling protrusions 411*b* may be formed on two sides of a first pipe 410*b* and coupling grooves 422*b* may be formed on two sides of a second pipe 420*b*. An entirely ring-shaped structure can be achieved by alternately arranging the first pipe 410*b* and the second pipe 420*b*.

Referring to FIG. 5A, in a ring-shaped cofferdam and temporary pit excavation structure using pipes 500 according to an embodiment of the present invention, when a first pipe 510*a* that is one of a plurality of pipes 510*a* and 520*a* has a coupling protrusion 511*a* formed in the longitudinal direction and a second pipe 520*a* that is one of the plurality of pipes 510*a* and 520*a* has a coupling groove 522*a* formed in the longitudinal direction to fit the coupling protrusion 511*a* therein, the coupling protrusion 511*a* of the first pipe 510*a* may have a trapezoidal cross-section and the coupling groove 522*a* of the second pipe 520*a* may be formed to correspond go the coupling protrusion 511*a*.

Further, referring to FIG. 5B, coupling protrusions 511*b* may be formed on two sides of the first pipe 510*b* and coupling grooves 522*b* may be formed on two sides of the second pipe 520*b*. An entirely ring-shaped structure can be achieved by alternately arranging the first pipe 510*b* and the second pipe 520*b*.

In the case of FIG. 5, the supporting force between the first pipe and the second pipe can be further improved than the case of FIG. 2.

Further, in the case of FIG. 4, since the coupling protrusion 411*a* is formed in a T-shape, the coupling protrusion 411*a* may be deformed or broken due to stress concentrating on the neck of the T-shape. On the other hand, in the case of FIG. 5, stress may concentrate on the short sides more than the long sides of the trapezoidal coupling protrusions 511*a* and the coupling area (jointing area) between the coupling protrusion 511*a* and the first pipe 510*a* is larger than that in the case of FIG. 4. Accordingly, the possibility of deformation or breakage of the coupling protrusion 511*a* is remarkably decreased, even though stress concentrates, as compared with the case of FIG. 4.

That is, there is the advantage in the case of FIG. 5 that the supporting force between the first pipe 510*a* and the second pipe 520*a* is further improved and there is little possibility of deformation or breakage of the coupling protrusions 511*a*.

Referring to FIG. 6, the ring-shaped cofferdam and temporary pit excavation structure using pipes 600 according to an embodiment of the present invention may have another coupling structure. As shown in FIG. 6A, a coupling portion 611*a* of a first pipe 610*a* may be formed in a step-shaped cross-section and a coupling portion 621*a* of a second pipe 620*a* may be formed to correspond to the coupling portion 611*a*, thereby forming a coupling structure.

Further, as shown in FIG. 6B, a coupling portion 611*b* of a first pipe 610*b* may have a cross-sectional shape extending and bending once from a step shape and a coupling portion 621*b* of a second pipe 620*b* may be formed to correspond to the coupling portion 611*b*, thereby forming a coupling structure.

Further, as shown in FIG. 6C, a coupling portion 611*c* of a first pipe 610*c* may have a cross-sectional shape extending and bending twice from a step shape and a coupling portion 621*c* of a second pipe 620*c* may be formed to correspond to the coupling portion 611*c*, thereby forming a coupling structure.

Figure 7:
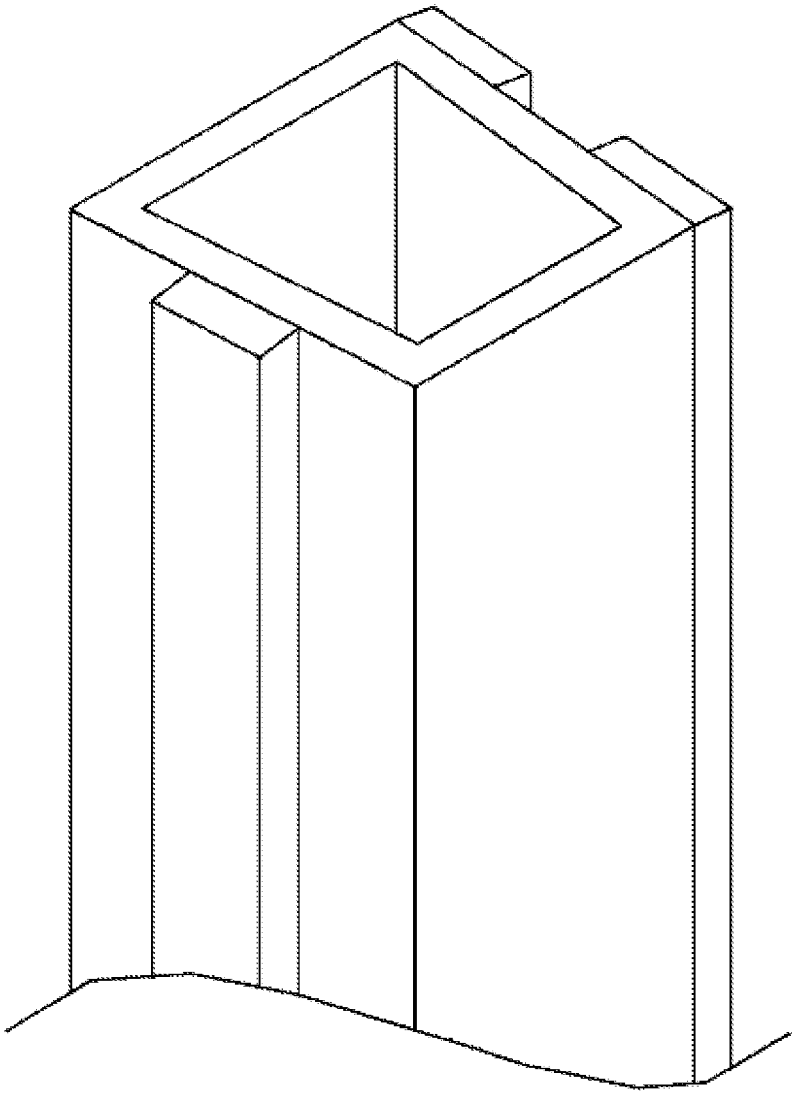
FIG. 7 is a perspective view of a pipe included in the ring-shaped cofferdam and temporary pit excavation structure using pipes according to an embodiment of the present invention.

FIG. 7 is a perspective view of a pipe included in the ring-shaped cofferdam and temporary pit excavation structure using pipes according to an embodiment of the present invention. FIG. 7 is a reference figure and the ring-shaped cofferdam and temporary pit excavation structure using pipes shown in FIG. 7 can be achieved by combining several pipes.

Figure 8:
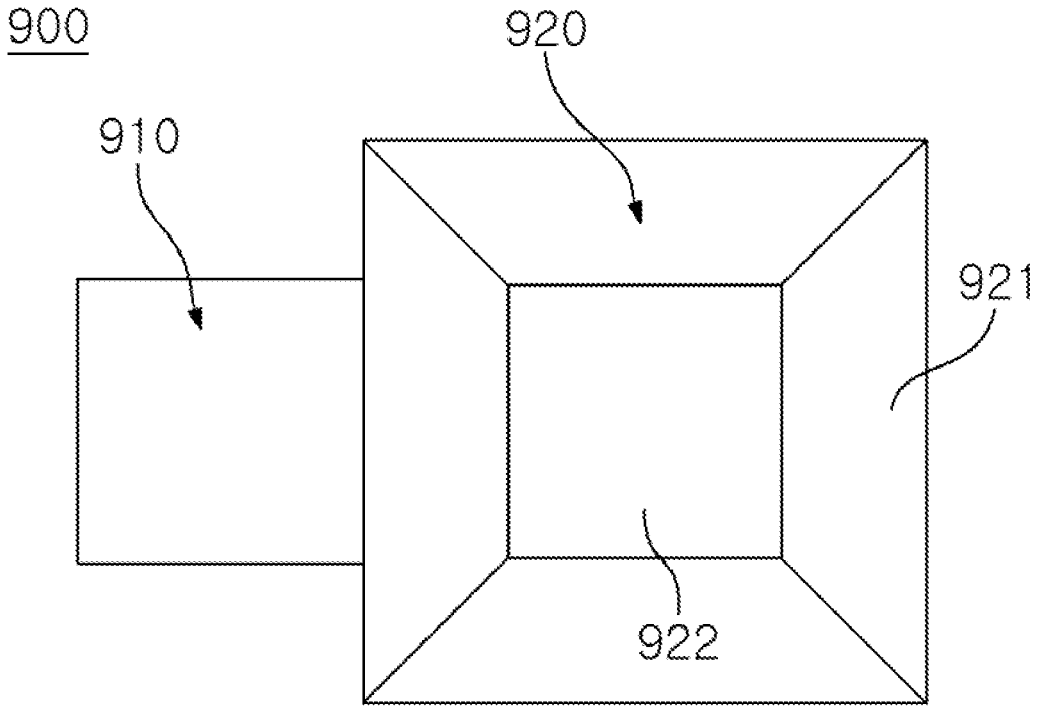
FIG. 8 is a plan view of a guide member according to an embodiment of the present invention.
Figure 9:
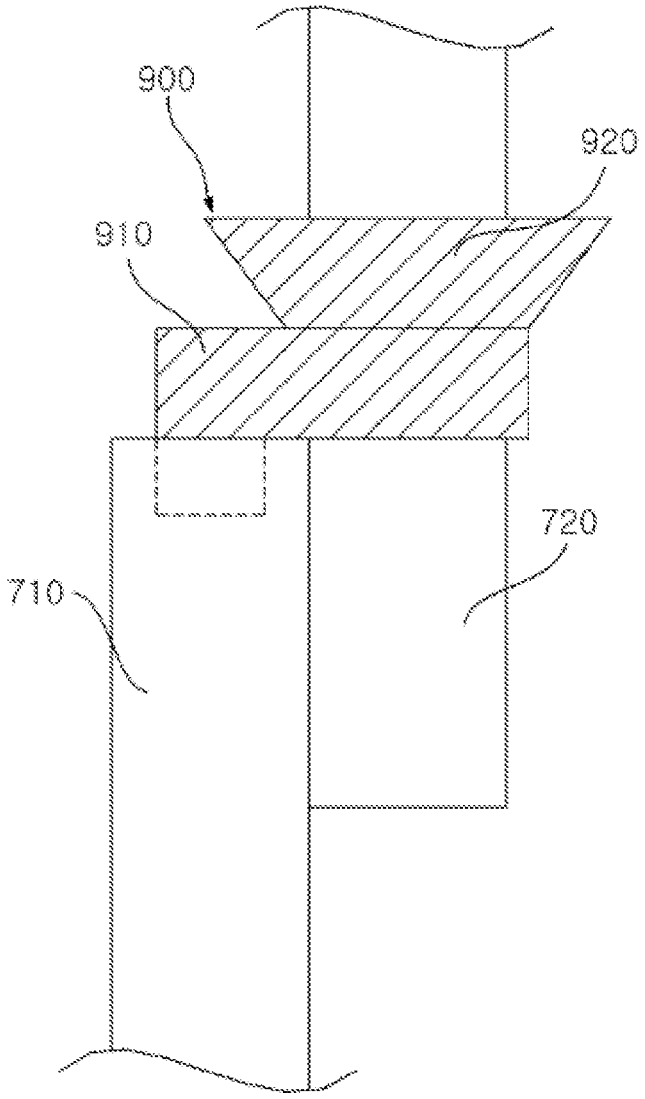
FIG. 9 is a view showing construction state using a guide member according to an embodiment of the present invention.

FIG. 8 is a plan view of a guide member according to an embodiment of the present invention and FIG. 9 is a view showing construction state using a guide member according to an embodiment of the present invention.

Referring to FIGS. 8 and 9, a guide member 900 according to an embodiment of the present invention may have: a fitting portion 910 that is fitted in the upper end of one of a plurality of pipes; and a guide portion 920 that horizontally extends from the fitting portion 910.

The fitting portion 910 may be formed in a rectangular pillar shape because a pipe is fitted therein.

Further, the guide portion 920 may include a tapered guide plate 921 decreasing in width toward the lower end from the upper end and an intake hole 922 formed at the lower end of the guide plate.

In the ring-shaped cofferdam and temporary pit excavation structure using pipes according to an embodiment of the present invention, it is required to continuously install a plurality of pipes (using a driving or boring method) using a crane, and particularly, coupling protrusions should be fitted in coupling grooves. However, it may not be easy for even skilled crane workers to accurately fit the coupling protrusion into the coupling grooves.

However, pipes are guided by the guide member 900 such that the lower ends of the pipes are easily coupled, so there is the advantage of easy installation.

Referring to FIG. 9, in detail, when a right pipe 720 is installed with a left pipe 710 installed, the right pipe 720 is installed with the fitting portion 910 of the guide member 900 fitted in the upper end of the left pipe 710, whereby installation becomes easy by the guide function of the guide member 720.

Further, the guide member 900 according to an embodiment of the present invention is easily detachably combined with a pipe, so even though pipes are continuously installed using a crane, one guide member 900 can be easily detachably used.

Figure 10:
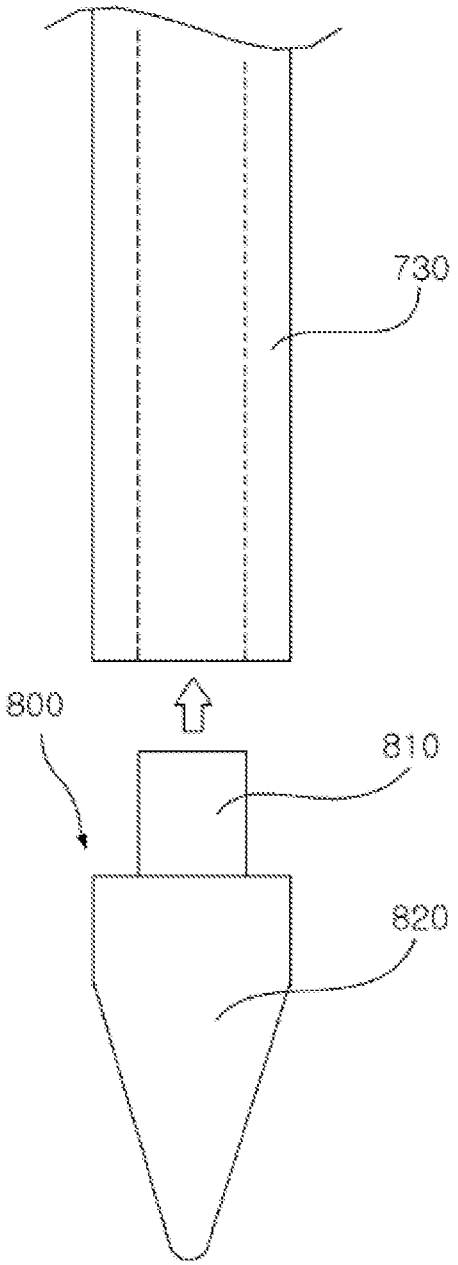
FIG. 10 is a view showing construction state using an anchor member according to an embodiment of the present invention.

FIG. 10 is a view showing construction state using an anchor member according to an embodiment of the present invention. Referring to FIG. 10, the ring-shaped cofferdam and temporary pit excavation structure using pipes according to an embodiment of the present invention may further include an anchor member 800 that is fitted in the lower end of one 730 of a plurality of pipes.

The anchor member 800 may have: a fitting portion 810 formed at the upper end of the anchor member to be fitted in the lower end of one 730 of a plurality of pipes; and an anchor portion 820 extending a predetermined length from the fitting portion 810 and decreasing in cross-sectional area toward the lower end.

Further, in the ring-shaped cofferdam and temporary pit excavation structure using pipes according to an embodiment of the present invention, the tapered cross-sections of some of a plurality of pipes may be inclined at different angles, so the structure can be formed in an ellipse. Such an elliptical structure can be applied, if necessary, depending on the surrounding environments.

FIGS. 11 to 14 are flowcharts of a method of constructing a ring-shaped cofferdam and temporary pit excavation structure using pipes according to an embodiment of the present invention.

Figure 11:
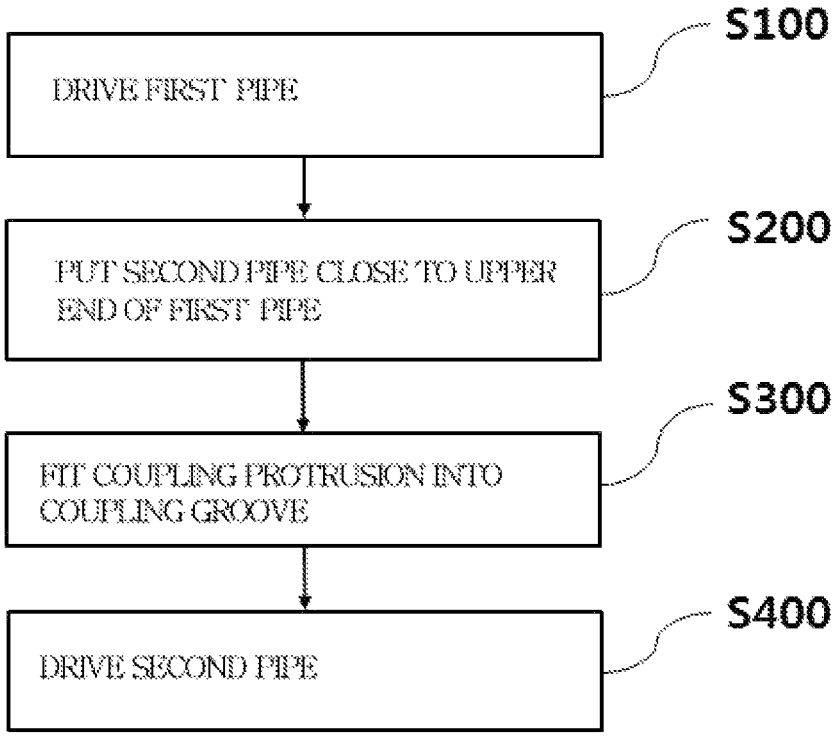
FIGS. 11 to 14 are flowcharts of a method of constructing a ring-shaped cofferdam and temporary pit excavation structure using pipes according to an embodiment of the present invention.

Referring to FIG. 11, a method of constructing a ring-shaped cofferdam and temporary pit excavation structure using pipes according to an embodiment of the present invention may include: driving a first pipe having a coupling groove formed in the longitudinal direction on a side (S100); putting a second pipe having a coupling protrusion formed in the longitudinal direction on a side close to the upper end of the first pipe (S200); fitting the coupling protrusion of the second pipe into the coupling groove of the first pipe (S300); and driving the second pipe with the coupling protrusion of the second pipe fitted in the coupling groove of the first pipe (S400).

Figure 12:
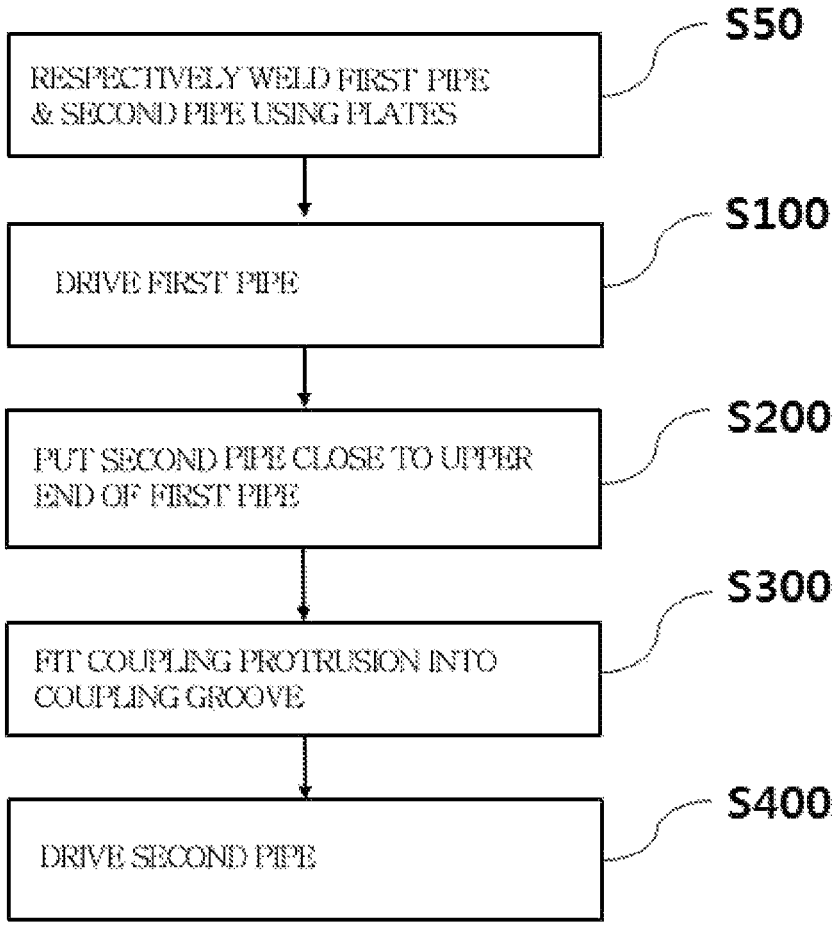

Referring to FIG. 12, a method of constructing a ring-shaped cofferdam and temporary pit excavation structure using pipes according to an embodiment of the present invention may include, before the driving of the first pipe; welding respectively the first pipe and the second pipe (S50); driving a first pipe having a coupling groove formed in the longitudinal direction on a side (S100); putting a second pipe having a coupling protrusion formed in the longitudinal direction on a side close to the upper end of the first pipe (S200); fitting the coupling protrusion of the second pipe into the coupling groove of the first pipe (S300); and driving the second pipe with the coupling protrusion of the second pipe fitted in the coupling groove of the first pipe (S400).

In step S50, the first pipe and the second pipe may be respectively welded using four flat plates.

Figure 13:
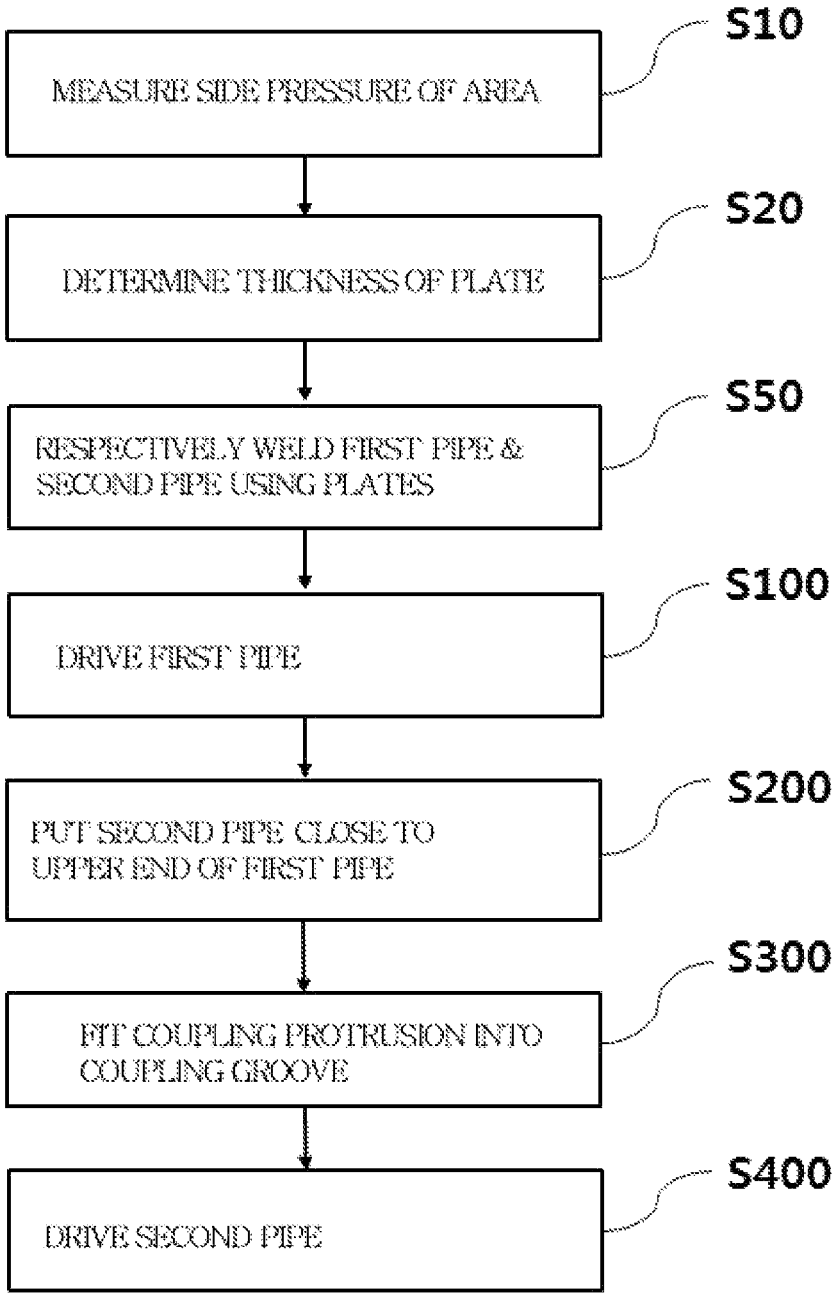

Referring to FIG. 13, a method of constructing a ring-shaped cofferdam and temporary pit excavation structure using pipes according to an embodiment of the present invention may include: measuring the side pressure of the area where the first pipe and the second pipe are installed (S10); determining the thickness of the plates in accordance with the result of measuring the side pressure (S20); welding respectively the first pipe and the second pipe (S50); driving a first pipe having a coupling groove formed in the longitudinal direction on a side (S100); putting a second pipe having a coupling protrusion formed in the longitudinal direction on a side close to the upper end of the first pipe (S200); fitting the coupling protrusion of the second pipe into the coupling groove of the first pipe (S300); and driving the second pipe with the coupling protrusion of the second pipe fitted in the coupling groove of the first pipe (S400).

In step S20, when the measured side pressure is less than a predetermined value, as the result of measurement, the thickness of the plates can be determined as 10% or less of the entire width of the first pipe or the second pipe. However, when the measured side pressure is more than a predetermined value, as the result of measurement, the thickness of the plates can be determined as 11% or more of the entire width of the first pipe or the second pipe.

That is, since the method of constructing a ring-shaped cofferdam and temporary pit excavation structure using pipes according to an embodiment of the present invention uses pipes, it is possible to adjust thickness, unlike circular steel pipes of the related art. Accordingly, it is possible to design and apply different thicknesses in accordance with surrounding side pressure.

Figure 14:
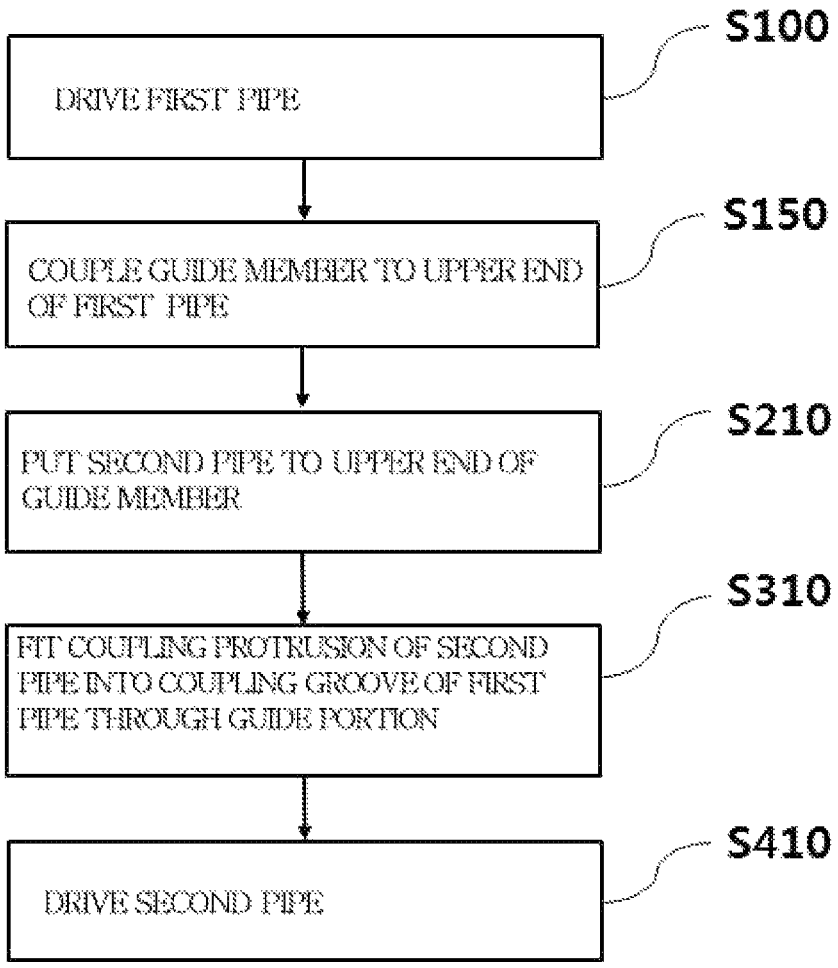

Referring to FIG. 14, a method of constructing a ring-shaped cofferdam and temporary pit excavation structure using pipes according to an embodiment of the present invention may include coupling a guide member to the upper end of the first pipe (S150) after the driving of the first pipe.

When a method of constructing a ring-shaped cofferdam and temporary pit excavation structure using pipes according to an embodiment of the present invention includes step S150, the entire method may include: driving a first pipe having a coupling groove formed in the longitudinal direction on a side (S100); coupling a guide member to the upper end of the first pipe (S150); putting the second pipe to the upper end of the first pipe (S210); fitting the coupling protrusion of the second pipe into the coupling groove of the first pipe through the guide member (S310); driving the second pipe with the coupling protrusion of the second pipe fitted in the coupling groove of the first pipe (S410). This construction method guides pipes through the guide member 900 such that the lower ends of the pipes are easily coupled, so there is the advantage of easy installation.

While the technical spirit of the present invention was described in detail through embodiments, it should be noted that the embodiments is for describing, not limiting, the present invention. Further, it should be noted that the present invention may be achieved in various ways by those skilled in the art without departing from the scope of the present invention. Therefore, the technical protective region of the present invention should be determined by the scope described in claims.

The invention claimed is:

1. A ring-shaped cofferdam and temporary pit excavation structure using pipes, the structure comprising a plurality of pipes having a trapezoidal cross-section, wherein the plurality of pipes each have a coupling protrusion or a coupling groove formed in a longitudinal direction on a first side, the plurality of pipes each have a coupling protrusion or a coupling groove formed in the longitudinal direction on a second side, the plurality of pipes are assembled by coupling the coupling protrusions and the coupling grooves, a long side of two parallel sides of the trapezoid is disposed outside, a short side is disposed inside, and a guide member that is fitted in an upper end of one of the plurality of pipes, wherein the guide member has:

a fitting portion that is fitted in an upper end of one of the plurality of pipes; and a guide portion that horizontally extends from the fitting portion.

2. The structure of claim 1, wherein the plurality of pipes include a first pipe and a second pipe, the coupling protrusion of the first pipe has a rectangular cross-section, and the coupling groove of the second pipe is formed to correspond to the coupling protrusion.

3. The structure of claim 1, wherein the plurality of pipes include a first pipe and a second pipe, the coupling protrusion of the first pipe has a T-shaped cross-section, and the coupling groove of the second pipe is formed to correspond to the coupling protrusion.

4. The structure of claim 1, wherein the plurality of pipes include a first pipe and a second pipe, the coupling protrusion of the first pipe has a trapezoidal cross-section, and the coupling groove of the second pipe is formed to correspond to the coupling protrusion.

5. The structure of claim 1, wherein the plurality of pipes include a first pipe and a second pipe, and the first pipe and the second pipe are combined by welding four flat plates.

6. The structure of claim 1, wherein tapered cross-sections of some of the plurality of pipes are inclined at different angles.

7. The structure of claim 1, further comprising an anchor member that is fitted in a lower end of one of the plurality of pipes, wherein the anchor member has:

a fitting portion formed at an upper end of the anchor member to be fitted in a lower end of one of the plurality of pipes; and an anchor portion extending a predetermined length from the fitting portion and decreasing in cross-sectional area toward a lower end, and an upper end of the anchor portion is larger in cross-sectional area than the fitting portion.

8. A method of constructing a ring-shaped cofferdam and temporary pit excavation structure using pipes, the method comprising:

driving a first pipe having a coupling groove formed in a longitudinal direction on a side;

putting a second pipe having a coupling protrusion formed in a longitudinal direction on a side close to an upper end of the first pipe;

fitting the coupling protrusion of the second pipe into the coupling groove of the first pipe;

driving the second pipe with the coupling protrusion of the second pipe fitted in the coupling groove of the first pipe, and welding respectively the first pipe and the second pipe before the driving of the first pipe, measuring side pressure of an area where the first pipe and the second pipe are installed;

determining thickness of the plates in accordance with the result of measuring the side pressure.

9. The method of claim 8, wherein the determining of thickness of the plates in accordance with the result of measuring the side pressure determines the thickness of the plates as 10% or less of entire width of the first pipe or the second pipe when the measured side pressure is less than a predetermined value, as the result of measurement.

10. The method of claim 8, wherein the determining of thickness of the plates in accordance with the result of measuring the side pressure determines the thickness of the plates as 11% or more of entire width of the first pipe or the second pipe when the measured side pressure is a predetermined value or more, as the result of measurement.

11. The method of claim 8, wherein the coupling protrusion of the first pipe has a rectangular cross-section, and the coupling groove of the second pipe is formed to correspond to the coupling protrusion.

12. The method of claim 8, wherein the coupling protrusion of the first pipe has a T-shaped cross-section, and the coupling groove of the second pipe is formed to correspond to the coupling protrusion.

13. The method of claim 8, wherein the coupling protrusion of the first pipe has a trapezoidal cross-section, and the coupling groove of the second pipe is formed to correspond to the coupling protrusion.

14. A method of constructing a ring-shaped cofferdam and temporary pit excavation structure using pipes, the method comprising:

driving a first pipe having a coupling groove formed in a longitudinal direction on a side;

putting a second pipe having a coupling protrusion formed in a longitudinal direction on a side close to an upper end of the first pipe;

fitting the coupling protrusion of the second pipe into the coupling groove of the first pipe;

driving the second pipe with the coupling protrusion of the second pipe fitted in the coupling groove of the first pipe; and coupling a guide member to the upper end of the first pipe after the driving of the first pipe, wherein the guide member has:

a fitting portion that is fitted in an upper end of one of the plurality of pipes; and a guide portion that horizontally extends from the fitting portion.

15. The method of claim 14, comprising, after the coupling of the guide member:

putting the second pipe to the upper end of the first pipe;

fitting the coupling protrusion of the second pipe into the coupling groove of the first pipe through the guide member; and driving the second pipe with the coupling protrusion of the second pipe fitted in the coupling groove of the first pipe.

* * * * *